US012228055B1

(12) United States Patent
Yi et al.

(10) Patent No.: US 12,228,055 B1
(45) Date of Patent: Feb. 18, 2025

(54) EXHAUST SYSTEM SENSOR AND HOUSING ASSEMBLY

(71) Applicant: Caterpillar Inc., Peoria, IL (US)

(72) Inventors: Yong Yi, Dunlap, IL (US); Nathan Folger, Chillicothe, IL (US); Christopher Schell, Altura, MN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/541,653

(22) Filed: Dec. 15, 2023

(51) Int. Cl.
*F01N 13/00* (2010.01)

(52) U.S. Cl.
CPC ..... *F01N 13/008* (2013.01); *F01N 2560/026* (2013.01)

(58) Field of Classification Search
CPC ..... F01N 13/008; F01N 2470/08; F01N 2560/02; F01N 2240/20; G01N 1/38; G01N 1/2252
See application file for complete search history.

(56) References Cited

U.S. PATENT DOCUMENTS 6,601,444 B2 8/2003 Ohmori et al.
6,843,104 B2 * 1/2005 Busch ..... G01N 33/0011 73/23.31
7,497,138 B2 3/2009 Kubinski et al.
10,066,535 B2 * 9/2018 Yi ..... F01N 3/2066
11,293,327 B2 * 4/2022 Yun ..... F01N 3/2066
11,725,561 B2 * 8/2023 Ringstad ..... F01N 13/008 60/274
2012/0180457 A1 * 7/2012 Liu ..... F01N 3/2066 73/23.31
2015/0160102 A1 * 6/2015 Denis ..... G01N 1/22 60/301
2015/0355066 A1 * 12/2015 Zhang ..... G01N 33/0011 73/23.31
2020/0408133 A1 * 12/2020 Burge ..... B01D 53/9431
2022/0205378 A1 * 6/2022 Ringstad ..... F01N 3/208
2023/0407782 A1 * 12/2023 Torii ..... F02B 77/086

* cited by examiner

*Primary Examiner* — Anthony Ayala Delgado
(74) *Attorney, Agent, or Firm* — Bookoff McAndrews, PLLC

(57) ABSTRACT

A sensor and housing assembly may include a sensor configured to detect a quantity of a gas in engine exhaust, and a housing including an inner upstream wall, a first inner side wall having a sensor opening for the sensor, an inner downstream wall opposite to the inner upstream wall, and a second inner side wall opposite to the first inner side wall, and having a housing inlet and a housing outlet that is opposite to the sensor opening in the first inner side wall. The sensor is positioned within the sensor opening on the first inner side wall, and a tip of the sensor protrudes through the housing outlet.

20 Claims, 5 Drawing Sheets

EXHAUST SYSTEM SENSOR AND HOUSING ASSEMBLY

TECHNICAL FIELD

The present disclosure relates generally to an exhaust system sensor and housing assembly, and more particularly, to an assembly having a housing and a sensor that detects quantities of gases, such as nitrogen oxides (NOx), in engine exhaust.

BACKGROUND

Exhaust from internal combustion engines must be monitored to maintain emissions compliance. In particular, emissions compliance is determined based on instantaneous average tailpipe nitrogen oxide (NOx) levels that are calculated based on measuring of NOx across an exhaust stream. In addition, control and maintenance of exhaust systems may also be performed based on such measured amounts of NOx across the exhaust stream. Such measuring requires a gas velocity, typically of 10 m/s or greater (in some cases, up to 60 m/s), of exhaust gas entering the sensor to achieve sufficient gas velocity within the sensor (sensor internal flow), and feeding exhaust from across and/or at various points along the exhaust stream to obtain an average concentration. To these ends, NOx sensors are typically inserted into openings within side walls of exhaust ducts (e.g., tailpipes), and are positioned within a housing or a boss that funnels or guides exhaust gas into the sensor, and a sampling tube is attached to the housing, and extends across the exhaust duct to capture exhaust across a diameter of the exhaust duct. Use of the sampling tube is also important as gases such as nitrogen oxides are not uniformly distributed within exhaust gas. The sampling tube has openings along a length thereof and on an upstream side relative to a direction of flow of the exhaust gas. The exhaust gas enters the openings, and flows into the housing and into the NOx sensor. The NOx sensor has an inlet, a sensing chamber in which a sensing element is located, and an outlet. The exhaust gas flows into the NOx sensor inlet, across the sensing element in the sensing chamber, and out from the outlet. Then, the exhaust gas flows through an outlet of the housing, and out of the exhaust duct. Of known configurations of housings and NOx sensors, some direct exhaust gas to flow into a tip of the sensor, up through a conical orifice of the sensor, through a sensing chamber, and out of a side of the sensor, and others direct exhaust gas to flow into a side of the sensor, through a sensing chamber, through a conical orifice of the sensor, out of the sensor tip, and out of a side of a housing. Such configurations can result in increased flow loss (that is, increased flow resistance), which can cause less accurate NOx measurements.

Currently, to obtain accurate measurements of NOx, exhaust gas needs to pass over the sensing element of the NOx sensor at a velocity of greater than 10 m/s. Such a gas velocity is required due to a lag between a time at which a volume of the exhaust gas passes the sampling tube to a time of measuring of NOx within that volume of exhaust gas. Further, although the use of sampling tubes provides for a greater number of points of collection across a tailpipe, exhaust gas that enters openings on the sampling tube, particularly the openings on the sampling tube that are farthest from the housing, may stagnate within the sampling tube, affecting the accuracy of the measurements of NOx.

U.S. Pat. No. 11,293,327 B2 (the '327 patent) discusses a sampling device used to direct exhaust gas flow toward a tip of a sensor located within an exhaust duct. In particular, a sensor housing is cup-shaped, with an open first end, open to a sensor opening, and an enclosed second end, and a wall with an upstream side and a downstream side. An inlet of the housing is within the upstream side of the wall, and an outlet of the housing is in the downstream side of the wall. A housing cover with a plurality of apertures is placed over an outlet opening and attached to the housing. A NOx sensor is mounted within the sensor opening and extends to a sensor tip enclosed by the wall and the enclosed end of the housing. However, as a result of the position of the sensor tip within the housing, the locations of inlet and the outlet of the housing, and the housing cover being placed over the sensor outlet opening, a velocity of exhaust gas flowing through the housing and across the sensor may be insufficient to ensure timely and accurate measurements of NOx in the exhaust gas.

The exhaust system sensor housing and related assembly of the present disclosure may solve one or more of the problems set forth above and/or other problems in the art. The scope of the current disclosure, however, is defined by the attached claims, and not by the ability to solve any specific problem.

SUMMARY

In one aspect of the present disclosure, a sensor and housing assembly may include a sensor configured to detect a quantity of a gas in engine exhaust, and a housing including an inner upstream wall, a first inner side wall having a sensor opening for the sensor, an inner downstream wall opposite to the inner upstream wall, and a second inner side wall opposite to the first inner side wall, and having a housing inlet and a housing outlet that is opposite to the sensor opening in the first inner side wall. The sensor is positioned within the sensor opening on the first inner side wall, and a tip of the sensor protrudes through the housing outlet.

According to another aspect of the present disclosure, a sensor and housing assembly may include a sensor configured to detect a quantity of a gas in engine exhaust and a housing including an inner upstream wall having an inlet, a first inner side wall having a sensor opening for the sensor, an inner downstream wall opposite to the inner upstream wall, and a second inner side wall opposite to the first inner side wall, and having an outlet that is opposite to the sensor opening. The sensor is positioned within the sensor opening in the first inner side wall, and a tip of the sensor protrudes through the outlet.

According to still another aspect of the present disclosure, an exhaust system assembly configured to be placed within a flow of engine exhaust may include an exhaust duct, a sensor configured to detect a quantity of a gas in the engine exhaust, and a housing having an inner upstream wall, a first inner sidewall, on a side of the housing adjacent to the exhaust duct, the first inner side wall having a sensor opening, an inner downstream wall opposite to the inner upstream wall, and a second inner side wall opposite to the first inner side wall and having a housing inlet and a housing outlet that is opposite to the sensor opening. The sensor is positioned within the sensor opening on the first inner side wall, and a tip of the sensor protrudes through the housing outlet.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion, such that a process, method, article, or apparatus that comprises a list of elements does not include only those elements, but may include other elements not expressly listed or inherent to such a process, method, article, or apparatus. Moreover, in this disclosure, relative terms, such as, for example, "about," "generally, "substantially," and "approximately" are used to indicate a possible variation of ±10% in the stated value.

Figure 1:
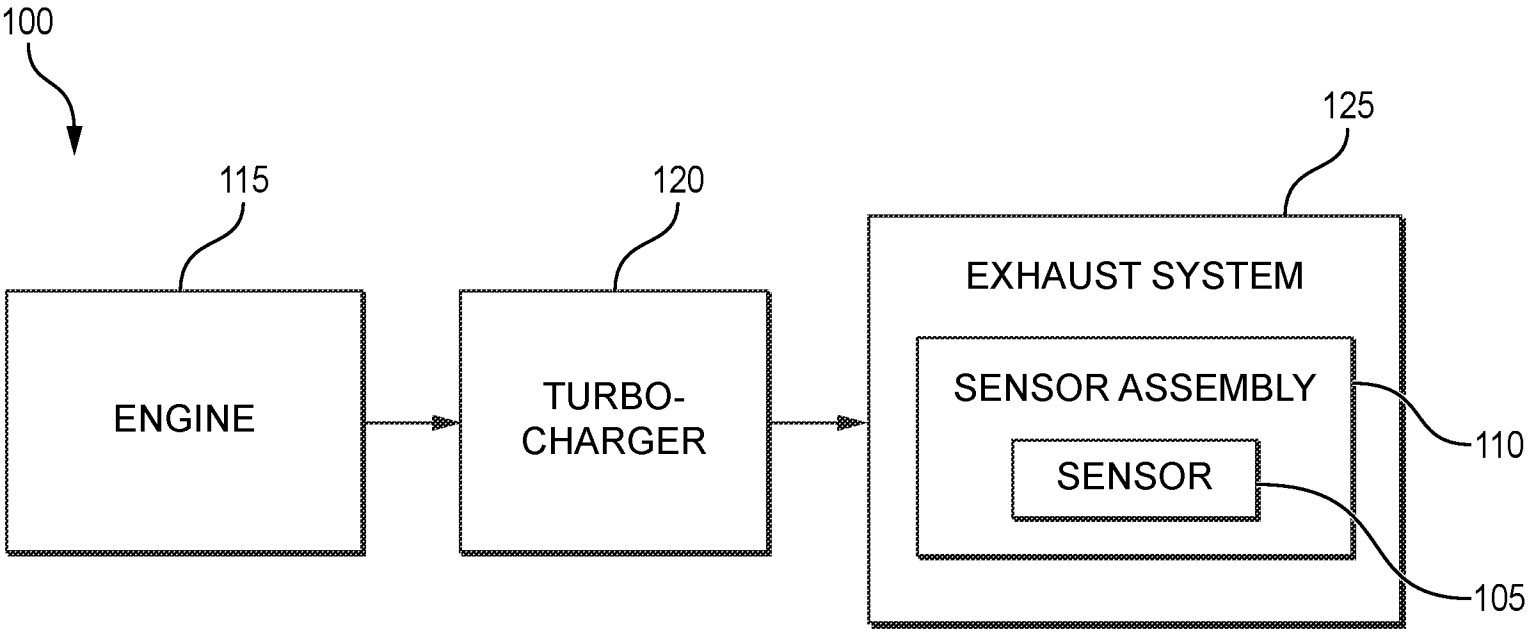
FIG. 1 schematically shows an engine system, which includes a NOx sensor as part of an exhaust system, in accordance with the present disclosure.

FIG. 1 schematically shows an engine system 100, which includes a sensor 105, such as a nitrogen oxide (NOx) sensor, which can detect nitric oxide and nitrogen dioxide, as part of an exhaust system sensor assembly 110, in accordance with the present disclosure. The engine system 100 includes an engine 115, such as an internal combustion engine, which may be used in a number of machine types, and which generates engine power to be supplied to the machine. The engine system 100 may also include a turbocharger 120 that is driven by exhaust gas to drive a compressor for boosting charge air pressure. An exhaust system 125 is provided to receive byproducts of the combustion process, such as nitrogen oxides, and other known pollutants and greenhouse gases. The exhaust system 125 may employ filters and/or selective catalytic reduction devices (SCRs) to convert byproducts of the combustion process into harmless components, such as converting nitrogen oxides into nitrogen and water, for example. The exhaust system 125 may also employ the exhaust system sensor assembly 110, which includes a housing 130 (shown in FIGS. 2-4) (or a housing 265 shown in FIG. 5), and the sensor 105, as discussed in more detail below. Although a single exhaust system sensor assembly 110 is shown in the schematic of FIG. 1, a plurality of such assemblies may be provided.

Figure 2:
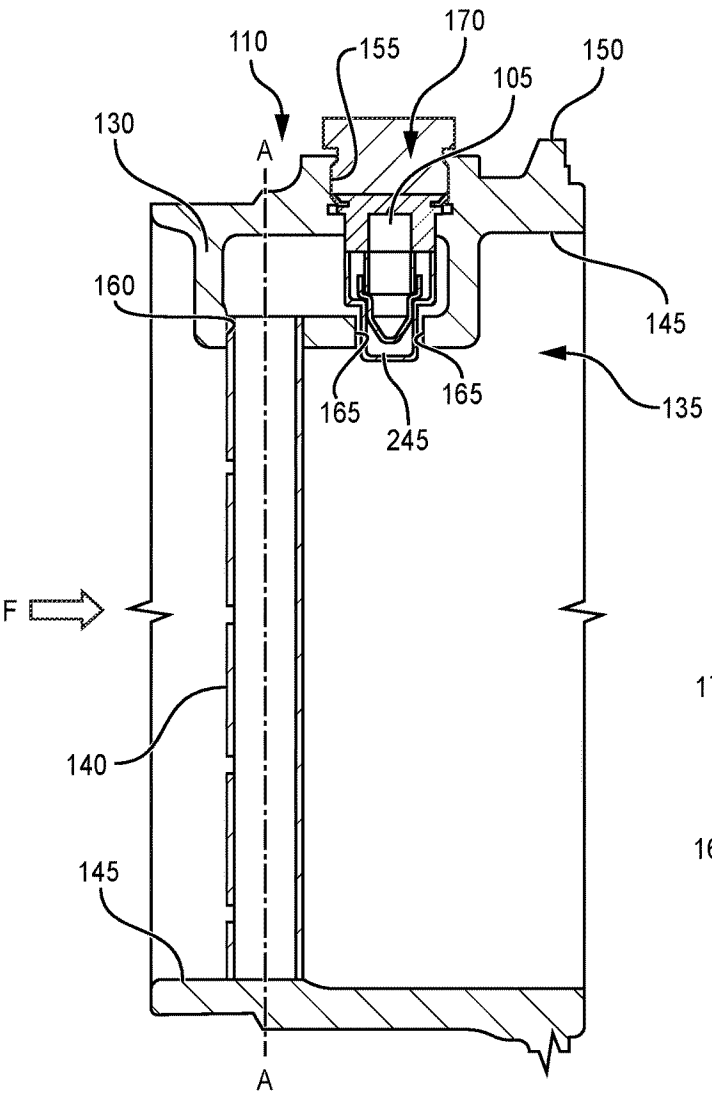
FIG. 2 shows a cross-sectional view of an exhaust pipe with a tube, a sensor, and a housing, in accordance with one embodiment the present disclosure.

FIG. 2 shows a cross-sectional view of an exhaust duct 135 with a sampling tube 140, the sensor 105, and the housing 130, in accordance with one embodiment the present disclosure. FIG. 2 also shows a direction of flow of exhaust gas, shown by arrow F. The exhaust duct 135 may be cylindrical, having an inner surface 145 and an outer surface 150. The sampling tube 140, the sensor 105, and the housing 130 may collectively form the exhaust system sensor assembly 110 that is configured to be placed within the exhaust duct 135 (for example, a tailpipe). As noted above, the sensor 105 may be a NOx sensor configured to detect quantities of nitric oxide and nitrogen dioxide within exhaust gas, although other types of sensors, and sensors used to detect other gases, may be used.

The housing 130 may be attached to the exhaust duct 135 or it may be integrally formed with the exhaust duct 135. In a case in which the housing 130 is attached to the exhaust duct 135, the exhaust duct 135 may have an opening 155 extending from the inner surface 145 to the outer surface 150 thereof, and the housing 130 may be inserted into and fixedly attached to the exhaust duct 135 (for example, welded) about the opening 155. In the example shown in FIG. 2, the housing 130 is formed integrally with the exhaust duct 135. The housing 130 has a housing inlet 160, a housing outlet 165, and a sensor opening 170, opposite to the outlet 165, and in which the sensor 105 is inserted. When installed within the exhaust duct 135 (or integrally formed therewith), and when the sensor 105 is installed in the sensor opening 170, the housing is enclosed except for the housing inlet 160 and the housing outlet 165.

One end of the sampling tube 140 may be rigidly attached to the housing inlet 160, and another end of the sampling tube 140 may be removably attached to the inner surface 145 of the exhaust duct 135, and is fixed to the inner surface 145 at a location approximately opposite to that of the housing 130. As discussed in more detail below, with respect to FIG. 4, the sampling tube 140 has a plurality of openings 260 facing upstream of the exhaust system sensor assembly 110. Although the sampling tube 140 is shown as extending straight across a diameter of the exhaust duct 135, the sampling tube 140 may be angled, relative to a diameter of the exhaust duct 135, curved relative to a diameter of the exhaust duct 135, or a combination of being linear, curved, and/or angled relative to a diameter of the exhaust duct 135. Angling or curving the sampling tube 140 may minimize or prevent stagnation of exhaust gas flowing through the sampling tube 140. As one specific example, an axis A-A of a linear sampling tube 140 may be at an angle of about 100 relative to a diameter of the exhaust duct 135, to minimize or prevent stagnation of the exhaust gas. In addition, although the sampling tube 140 is shown as a linear tube portion, the sampling tube 140 may be formed in other configurations, such as two linear tube portions crossing one another, a combination of a linear tube portion extending across a diameter of the exhaust pipe and one or more angled, linear tube portions, or a combination of one or more linear tube portions and a circular tube portion.

Figure 3A:
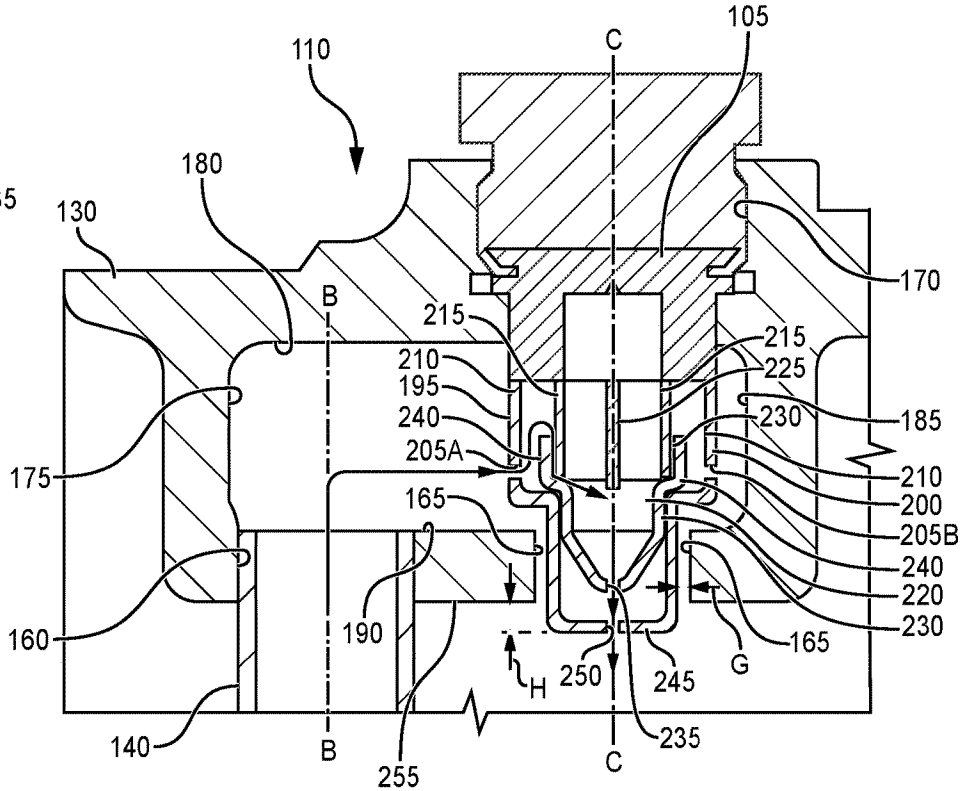
FIG. 3A shows a cross-sectional detail view of the sensor and the housing shown in FIG. 2.

FIG. 3A shows a cross-sectional detail view of the sensor 105, the housing 130, and the sampling tube 140 shown in FIG. 2. In particular, FIG. 3A shows the housing inlet 160, the housing outlet 165, and the sensor opening 170. In addition, the housing 130 has an inner upstream wall 175, an inner mounting side wall 180, an inner downstream wall 185 opposite to the inner upstream wall 175, and an inner side wall 190 opposite to the inner mounting side wall 180. The inner mounting side wall 180 is on a side of the housing 130 to be mounted within or integrally formed with the exhaust duct 135, and has the sensor opening 170 formed therein. The housing inlet 160 and the housing outlet 165 are within the inner side wall 190, and the housing outlet 165 is opposite to the sensor opening 170 in the inner mounting side wall 180.

The sensor 105 is shown inserted into the housing 130, and is positioned within the sensor opening 170 on the inner mounting side wall 180. The sensor 105 includes an upstream side 195, facing the inner upstream wall 175 of the housing 130, and a downstream side 200, facing the inner downstream wall 185 of the housing 130. At least one outer wall opening 205A is provided in an outer wall 210 on the upstream side 195 of the sensor 105, and a second outer wall opening 205B may be provided in the outer wall 210 on the downstream side 200 of the sensor 105. The sensor 105 has an inner wall 215, within the outer wall 210, the inner wall 215 surrounding a sensing chamber 220, and a sensing element 225 within the sensing chamber 220. The outer wall 210 and the inner wall 215 of the sensor 105 may be annular or cylindrical. The sensor 105 also has a conical insert 230 with an orifice or opening 235 at one end and walls 240 at another end, which extend in between the outer wall 210 and the inner wall 215 of the sensor 105. Also, the sensor 105 has a sensor tip 245 extending from the conical tip 230 of the sensing chamber 220, with an opening 250 provided therein. The sensor tip 245 extends from within the housing 130 and through the housing outlet 165, such that a distal end of the sensor tip 245 is exposed to exhaust gas flowing through the exhaust duct 135. The sensor tip 245 may extend through the housing outlet 165 and beyond an outer surface 255 of the housing 130 by a predetermined amount or distance H which may be, for example, about 1 mm or less.

Exhaust gas is configured to flow into at least one of the outer wall openings 205 of the sensor 105, around the walls 240 of the conical insert 230 and the inner wall 215 of the sensor 105, into the sensing chamber 220, across the sensing element 225, through the opening 235 in the conical tip 230 of the sensing chamber 220, and through the opening 245 in the sensor tip 245, as shown by the arrows in FIG. 3A. This flow path represents the least resistant flow path for exhaust gas through the sensor 105, and as discussed in more detail below, this arrangement of the housing 130 and the sensor 105 provides for sufficient velocity of exhaust gas passing through the sensor 105 to provide fast and accurate measurements. This arrangement of the sensor 105 results in the sensor tip 245 being exposed to exhaust gas and maximizes flow of exhaust gas through the sensor 105.

Figure 3B:
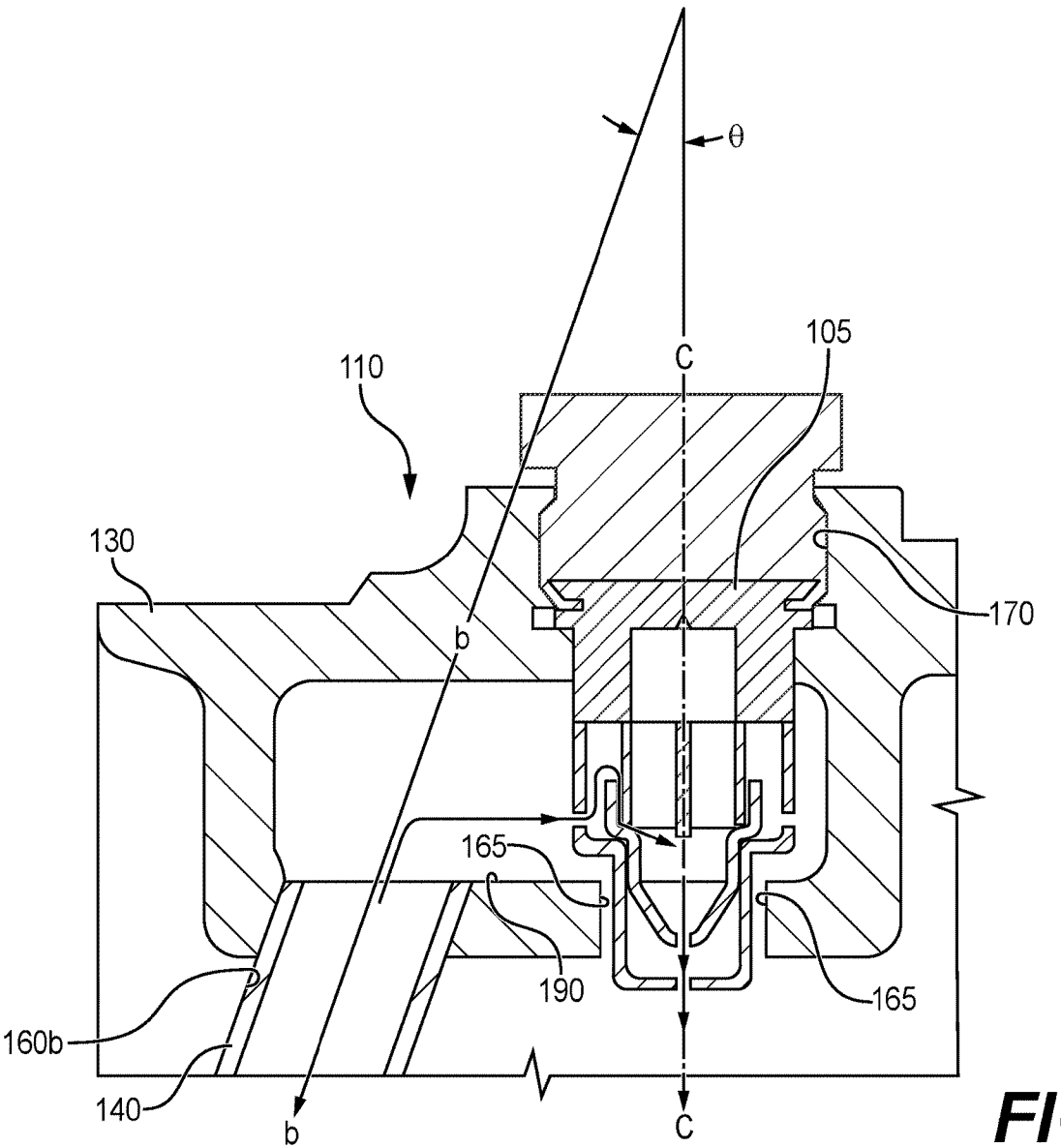
FIG. 3B shows a cross-section detail view of the sensor and a housing in accordance with an alternative embodiment of the present disclosure.

In the embodiment shown in FIG. 3A, the housing inlet 160 has an inlet axis B-B that is perpendicular to the inner mounting side wall 180. In addition, the housing outlet 165 has an outlet axis C-C that is perpendicular to the inner mounting side wall 180. That is, the inlet axis B-B and the outlet axis C-C are parallel to each other, and both are perpendicular to the inner mounting side wall 180. In other embodiments, the inlet axis B-B may be at an angle relative to the inner mounting side wall 180 and/or relative to the outlet axis C-C. As one example of such an embodiment, a housing inlet 160*b* may have an inlet axis b-b at an acute or obtuse angle, for example, and angle of about 10°, relative to the outlet axis C-C of the housing outlet 165, as shown in FIG. 3B, though the remaining aspects of the housing 130 and the sensor 105 of the assembly 110 are otherwise the same as in FIG. 3A. The arrangement of the housing inlet 160 relative to the outer wall openings 205 on the upstream side 195 of the sensor 105, results in exhaust gas being funneled or directed into the sensor 105 from the upstream side 195 thereof, which improves the speed and accuracy of measurements by the sensor 105.

In addition, in the embodiment shown in FIG. 3A, the housing outlet 165 may be dimensioned to allow for a gap G between the sensor tip 245 and the housing outlet 165. The gap G may be provided to allow for manufacturing tolerance, particularly as to variations in size of the sensor tips. In particular, for example, the housing outlet 165 may be dimensioned to allow for a gap G of about 0.4 mm between the housing outlet 165 and the sensor tip 245. As noted above, at least some of the exhaust gas flows into the sensor 105 to pass the sensing element 225 within the sensing chamber 220, but some of the exhaust gas also flows around the sensor 105 and through the gap G between the housing outlet 165 and the sensor tip 245. The gap G between the housing outlet 165 and the sensor tip 245 may be adjusted, for example, based on a diameter of openings 260 in the sampling tube 140, discussed below and shown in FIG. 4, to ensure accurate measurements of the sensor 105. A ratio between a size, e.g., a width, of the gap G to a diameter of the openings 260 may be predetermined, for example, 1:1, such that the width of the gap G may be increased, when forming the housing outlet 165, based on an increase of a diameter of the openings 260.

Figure 4:
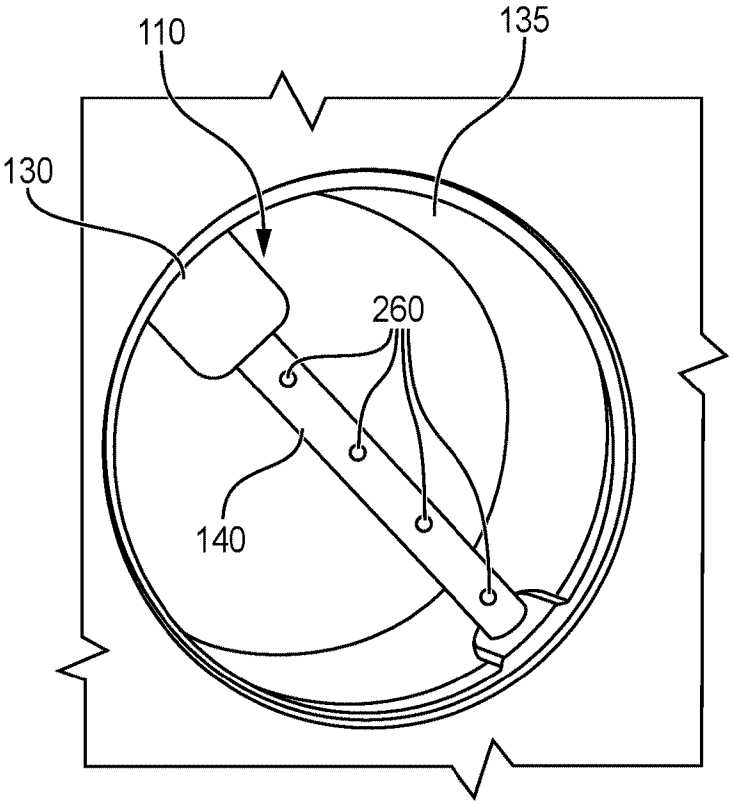
FIG. 4 shows a schematic side view of the tube and the housing shown in FIG. 2 from an exhaust-upstream location.

FIG. 4 shows a schematic side view of the sampling tube 140 and the housing 130 shown in FIG. 2. In particular, FIG. 4 shows the sampling tube 140 having openings 260 formed on one side thereof, along its length, and facing upstream within the exhaust system sensor housing 110. In the embodiment shown in FIG. 4, the sampling tube 140 has four openings 260, although the sampling tube 140 may have a lesser or a greater number of openings. In addition, in the embodiment shown in FIG. 4, the openings 260 of the sampling tube 140 are circular, having diameters of about 4 mm. However, the shapes and dimensions of the openings 260 of the sampling tube 140 are not limited to those of the embodiment of FIG. 4.

Figure 5:
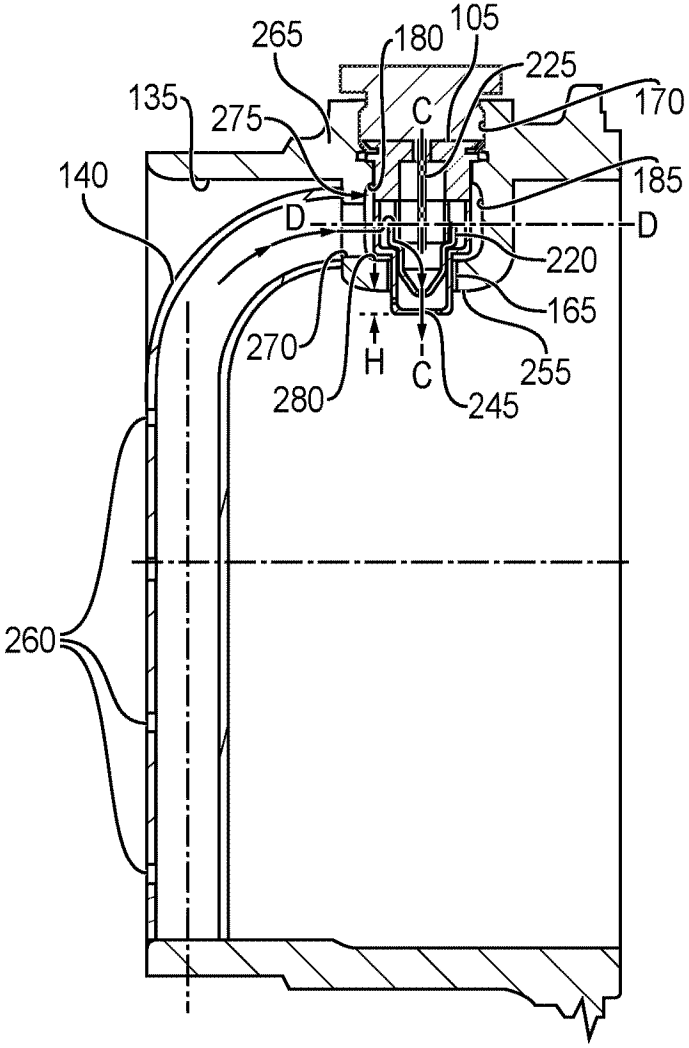
FIG. 5 shows a cross-sectional view of an exhaust pipe with a tube, a sensor, and a housing, in accordance with another embodiment of the present disclosure.

FIG. 5 shows a cross-sectional view of an exhaust duct 135 with the sampling tube 140, the sensor 105, and a housing 265 in accordance with another embodiment of the present disclosure. In particular, FIG. 5 shows a housing inlet 270 of the housing 265, in a different location relative to the housing inlet 160 of the embodiment shown in FIGS. 2-4. The housing outlet 165, the sensor opening 170, the inner mounting side wall 180, and the inner downstream wall 185 are the same as those in the embodiment shown in FIGS. 2-4. In addition, the housing 265 has an inner upstream wall 275 in which the housing inlet 270 is formed, and an inner side wall 280 opposite to the inner mounting side wall 180, with the housing outlet 165 being formed in the inner side wall 280, as shown in FIG. 5. As with the embodiment shown in FIG. 3A, the inner mounting side wall 180 is on a side of the housing 265 to be mounted within or integrally formed with the exhaust duct 135, and has the sensor opening 170 formed therein, and the housing outlet 165 is opposite to the sensor opening 170 in the inner mounting side wall 180.

In the embodiment shown in FIG. 5, as in the embodiment shown in FIGS. 2-4, the sensor 105 is shown inserted into the housing 265, and is positioned within the sensor opening 170 on the inner mounting side wall 180, and the sensor tip 245 extends through the housing outlet 165. The sensor tip 245 may extend through the housing outlet 165 and beyond an outer surface 255 of the housing 265 by a predetermined amount or distance H, which may be about 1 mm or less. The arrows in FIG. 5 show the flow path of exhaust gas through the housing 265 and the sensor 105.

In the embodiment shown in FIG. 5, an inlet axis D-D of the housing inlet 270 is parallel to the inner mounting side wall 180 of the housing 265, and the sampling tube 140 is partially straight, so that the openings 260 face upstream in the exhaust duct 135, and partially curved, so that one end of the sampling tube is connected to the housing inlet 270. In addition, as in the embodiment shown in FIGS. 2-4, the outlet axis C-C is perpendicular to the inner mounting side wall 180. That is, the inlet axis D-D and the outlet axis C-C are perpendicular to each other. In other embodiments, the inlet axis D-D may be at an angle relative to the inner mounting side wall 180 and/or relative to the outlet axis C-C. In still other embodiments, the outlet axis C-C may be at an angle relative to a diameter of the exhaust duct 135. As one example of such an embodiment, the outlet axis C-C may be at an angle of, for example, about 10°±1°, relative to the diameter of the exhaust duct 135, such that the outlet axis C-C faces in a slight downstream direction within the exhaust duct 135.

In addition, although not shown in FIG. 5 for simplicity, as with the embodiment shown in FIGS. 2-4, in this embodiment, the housing outlet 265 may be dimensioned to allow for the gap G between the sensor tip 245 and the housing outlet 165. In particular, for example, the housing outlet 165 may be dimensioned to allow for the gap G of about 0.4 mm between the housing outlet 165 and the sensor tip 245. As noted above, at least some of the exhaust gas flows through the sensor 105 to pass the sensing element 225 within the sensing chamber 220, but some of the exhaust gas also flows around the sensor 105 and through the gap G between the housing outlet 165 and the sensor tip 245.

Figure 6:
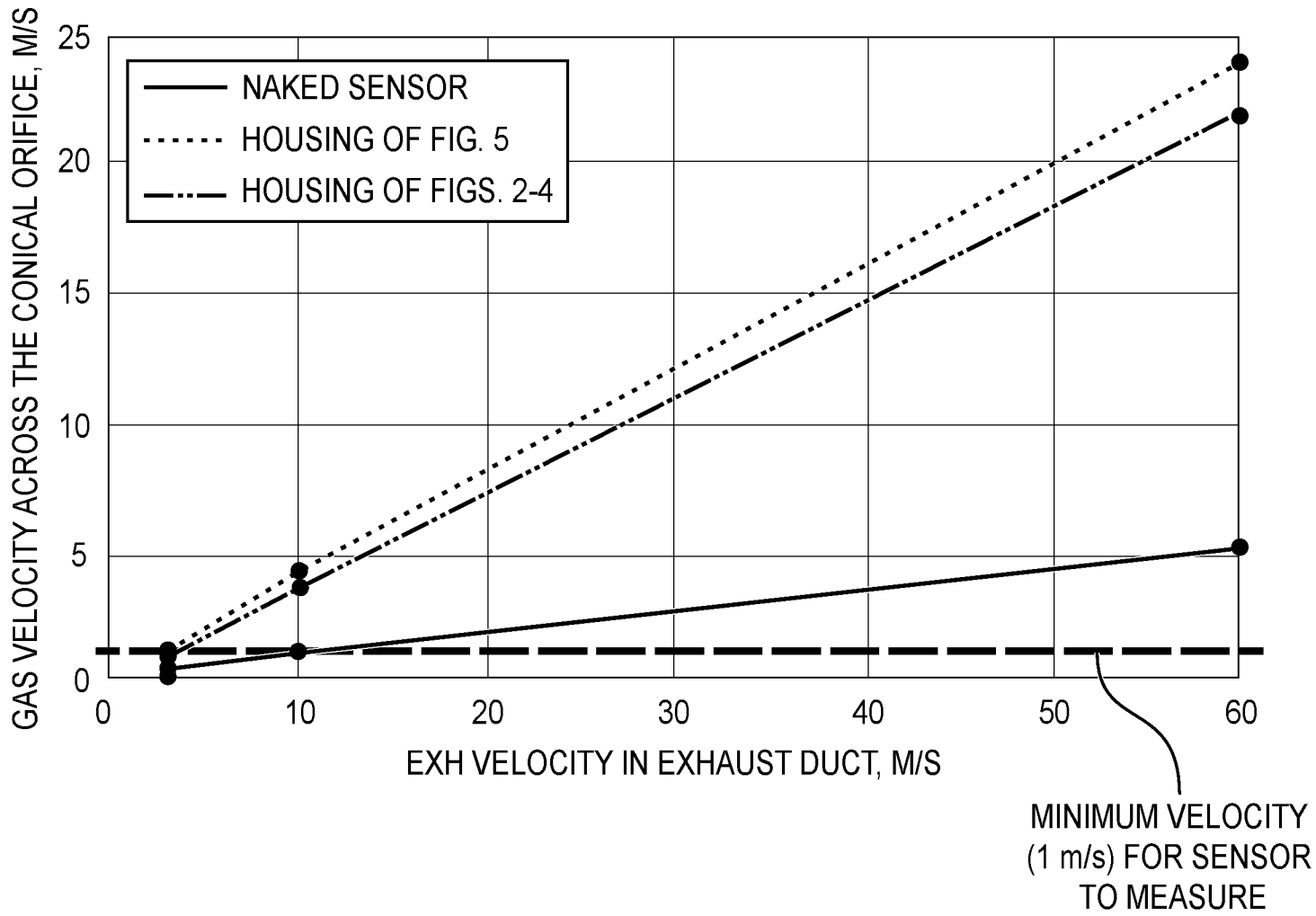
FIG. 6 shows a graph of a velocity of engine exhaust in a tail pipe of the exhaust system plotted against a velocity of gas across a conical orifice of a sensor.

FIG. 6 shows a graph of a velocity of exhaust gas in an exhaust duct 135 of the exhaust system 125 plotted against a velocity of exhaust gas across the opening 235 in the conical insert 230 of the sensor 105 (that is, velocity of exhaust gas passing through the opening 235) to compare sensor performance. In particular, FIG. 6 shows a relationship between a velocity of exhaust gas in the exhaust duct 135 and a velocity of exhaust gas across the opening 235 of the conical insert 230 of the sensor 105 when (1) the sensor 105 is without a housing (i.e., a naked sensor), (2) the sensor 105 is within the housing 265 of the embodiment shown in FIG. 5, and (3) the sensor 105 is within the housing 130 of the embodiment shown in FIGS. 2-4. A relatively thicker horizontal dashed line indicates 1 m/s of velocity of exhaust gas across the opening 235 of the conical insert 230 of the sensor 105, which is the minimum velocity required for the sensor 105 to generate a correct measurement. The graph demonstrates that, when the sensor 105 is within the housing 130 of the embodiment shown in FIGS. 2-4 or within the housing 265 of the embodiment shown in FIG. 5, it is possible to obtain accurate readings from the sensor 105 at relatively low velocities (e.g., less than 10 m/s). In other words, by placing the sensor 105 within the housing 130 or the housing 265 as disclosed herein, it is possible to obtain accurate readings from the sensor 105 even when velocity of the exhaust gas within the exhaust duct is relatively low.

INDUSTRIAL APPLICABILITY

The exhaust system sensor assembly 110 and the housing 130 (or 265) of the present disclosure are configured for use in exhaust systems 125 to provide accurate measurements from sensors 105, such as NOx sensors, for monitoring and controlling quantities of certain gases within exhaust gas to maintain emissions compliance.

With reference to FIGS. 1 and 2, during operation of the engine 115, exhaust gas flows from the exhaust system 125 to the exhaust duct 135 in the direction of arrow F, shown in FIG. 2, toward the assembly 110, including the sampling tube 140, the housing 130 (or 265), and the sensor 105, is located. Some of the exhaust gas flows into the openings 260 in the sampling tube 140, and into the housing inlet 160 (or 270). Some of the exhaust gas having entered the housing 130 (or 265) flows into the outer wall openings 205 on the upstream side 195 of the sensor 105, and passes over the sensing element 225, which measures amounts of individual gases (e.g., nitrogen oxides) in the exhaust gas. The remainder of the exhaust gas that has entered the housing 130 (or 265) flows around the sensor 105 and through the housing outlet 165, passing through the gap G between the housing outlet 165 and the sensor tip 245.

In addition, by providing a housing 130 (or 265) with an inlet 160 (or 270) within the inner side wall 190 of the housing 130, or within the inner upstream wall 275 of the housing 265, the present invention permits exhaust gas to flow through a side of the housing 130 (or 265) and into a side of the sensor 105, improving the timeliness and accuracy of measurements by the sensor 105. That is, the housings 130 and 265 described herein improve the performance of the sensor 105 by increasing the velocity of exhaust gas passing through the housing 130 (or 265) and into the sensor 105, to have sufficient gas velocity within the sensor 105 (sensor internal flow) and, in turn, to ensure accurate measurements by the sensor 105. The increased velocity is achieved by the arrangement of the housing inlet 160 (or 270) and the housing outlet 165 and the positioning of the sensor 105 within the housing 130 (or 265), all of which serve to guide the exhaust gas into the side of the sensor 105 and lower the pressure at the sensor outlet 165. Further, as demonstrated by the data in the graph of FIG. 6, using the housings 130 and 265 and assemblies 110 as described herein allows one to obtain fast and accurate readings of gas quantities in exhaust gas even when velocity of exhaust gas in the exhaust duct 135 is less than 10 m/s. That is, the assemblies 110 of housings 130 and 265 and sensors 105 described herein make it possible to obtain fast and accurate measurements of gases, such as nitrogen oxides, within exhaust gas, even when the exhaust gas flows through the exhaust duct 135 at a speed of 10 m/s or less.

In addition, by providing a housing 130 (or 265) with a housing outlet 165 through which a sensor tip 245 extends, and by providing a gap G between the housing outlet 165 and the sensor tip 245, the present invention creates an increased flow of exhaust gas through the housing 130 (or 265) and across the sensor 105, and a lowering of pressure at the opening 250 in the sensor tip 245, thus improving the timeliness and accuracy of measurements by the sensor 105. And, as demonstrated by the data in the graph of FIG. 6, the improved speed and accuracy of measurements by the sensor 105 were possible even with use of a sampling tube 140, in which stagnation may occur.

The housings 130 and 265 and related assemblies 110 described herein also provide for a relatively compact and flexible assembly 110 that can be used at different locations in an exhaust after treatment system, such as in a tailpipe or in catalyst canisters of SCRs, for example. In addition the housings 130 and 265 and related assemblies 110 can be used with different gas sampling devices, such as single flute or multiple flute devices.

It will be apparent to those skilled in the art that various modifications and variations can be made to the disclosed NOx sensor housing and related assembly, without departing from the scope of the disclosure. Other embodiments of the NOx sensor housing and related assembly will be apparent to those skilled in the art from consideration of the specification and the accompanying figures. It is intended that the specification, and, in particular, the examples provided herein be considered as exemplary only, with a true scope of the disclosure being indicated by the following claims and their equivalents.

We claim:

1. A sensor and housing assembly comprising:

a sensor configured to detect a quantity of a gas in engine exhaust; and a housing including:

an inner upstream wall;

a first inner side wall having a sensor opening for the sensor;

an inner downstream wall opposite to the inner upstream wall; and a second inner side wall opposite to the first inner side wall, and having a housing inlet and a housing outlet that is opposite to the sensor opening in the first inner side wall, wherein the housing inlet is upstream of the housing outlet, relative to a direction of flow of the gas in the engine exhaust, wherein the sensor is positioned within the sensor opening on the first inner side wall, and a tip of the sensor protrudes through the housing outlet.

2. The sensor and housing assembly of claim 1, wherein an axis of the housing inlet is perpendicular to the first inner side wall.

3. The sensor and housing assembly of claim 1, wherein an axis of the housing outlet is perpendicular to the first inner side wall.

4. The sensor and housing assembly of claim 1, wherein an axis of the housing inlet is at an angle of about 10° relative to an axis of the housing outlet.

5. The sensor and housing assembly of claim 1, wherein the housing outlet is dimensioned to allow for a gap between the tip of the sensor and the housing outlet.

6. A sensor and housing assembly comprising:

a sensor configured to detect a quantity of a gas in engine exhaust; and a housing including:

an inner upstream wall having a housing inlet;

a first inner side wall having a sensor opening for the sensor;

an inner downstream wall opposite to the inner upstream wall; and a second inner side wall opposite to the first inner side wall, and having a housing outlet that is opposite to the sensor opening, wherein the housing inlet is upstream of the housing outlet, relative to a direction of flow of the gas in the engine exhaust, wherein the sensor is positioned within the sensor opening in the first inner side wall, and a tip of the sensor protrudes through the outlet.

7. The sensor and housing assembly of claim 6, wherein an axis of the inlet is parallel to the first inner side wall.

8. The sensor and housing assembly of claim 6, wherein an axis of the outlet is perpendicular to the first inner side wall.

9. The sensor and housing assembly of claim 6, wherein an axis of the inlet is at an angle of about 10° relative to the first inner side wall.

10. The sensor and housing assembly of claim 6, wherein the housing outlet is dimensioned to allow for a gap between the tip of the sensor and the housing outlet.

11. An exhaust system assembly configured to be placed within a flow of gas in an engine exhaust, the assembly comprising:

an exhaust duct;

a sensor configured to detect a quantity of the gas in the engine exhaust; and a housing having:

an inner upstream wall;

a first inner sidewall, on a side of the housing adjacent to the exhaust duct, the first inner side wall having a sensor opening;

an inner downstream wall opposite to the inner upstream wall; and a second inner side wall opposite to the first inner side wall and having a housing inlet, through which the gas of the engine exhaust enters the housing, and a housing outlet that is opposite to the sensor opening, wherein the sensor is positioned within the sensor opening on the first inner side wall, and a tip of the sensor protrudes through the housing outlet.

12. The exhaust system assembly of claim 11, wherein an axis of the housing inlet is perpendicular to the first inner side wall.

13. The exhaust system assembly of claim 11, wherein an axis of the housing outlet is perpendicular to the first inner side wall.

14. The exhaust system assembly of claim 11, wherein an axis of the housing inlet is at an angle of about 10° relative to an axis of the housing outlet.

15. The exhaust system assembly of claim 11, wherein the housing outlet is dimensioned to allow for a gap between the tip of the sensor and the housing outlet.

16. The exhaust system assembly of claim 15, wherein the gap is about 0.4 mm.

17. The exhaust system assembly of claim 11, wherein the sensor is a nitrogen oxide (NOx) sensor.

18. The exhaust system assembly of claim 11, further comprising a sampling tube having one end attached to the inlet of the housing, and having one or more openings along a length thereof through which the flow of the engine exhaust passes.

19. The exhaust system assembly of claim 18, wherein the sampling tube has four openings, and each opening has a diameter of about 4 mm.

20. The exhaust system assembly of claim 18, wherein another end of the sampling tube is configured to be fixed to an inner surface of the exhaust duct opposite to a location of the housing.

* * * * *